US008202014B2

(12) United States Patent
Komuro et al.

(10) Patent No.: US 8,202,014 B2
(45) Date of Patent: Jun. 19, 2012

(54) RECORDING APPARATUS

(75) Inventors: Shintaro Komuro, Shiojiri (JP); Nobuhiko Shinozaki, Shiojiri (JP); Tomoya Takikawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 539 days.

(21) Appl. No.: 12/426,668

(22) Filed: Apr. 20, 2009

(65) Prior Publication Data

US 2009/0269116 A1 Oct. 29, 2009

(30) Foreign Application Priority Data

Apr. 23, 2008 (JP) ..... 2008-112195

(51) Int. Cl.
*B41J 13/12* (2006.01)

(52) U.S. Cl. ..... 400/525; 400/527

(58) Field of Classification Search ..... 400/521, 400/525; 358/1.15–1.18
See application file for complete search history.

(56) References Cited

U.S. PATENT DOCUMENTS

| | | | | |
|---|---|---|---|---|
| 7,033,014 | B2 | 4/2006 | Ohashi et al. | |
| 2006/0114280 | A1 * | 6/2006 | Koide et al. | 347/16 |
| 2007/0109601 | A1 * | 5/2007 | Mitani | 358/1.18 |

FOREIGN PATENT DOCUMENTS

| | | |
|---|---|---|
| CN | 1537727 A | 10/2004 |
| JP | 2005-059584 | 3/2005 |

* cited by examiner

*Primary Examiner* — Seung Lee
*Assistant Examiner* — Christle Marshall
(74) *Attorney, Agent, or Firm* — Workman Nydegger

(57) ABSTRACT

A recording apparatus includes a recording head, a holding tray on which a first recording material is set and which is configured to be advanced and retracted in a linear path between a first position wherein it opposes the recording head and a second position wherein it is retracted from the first position, a reverse transporting portion for transporting a second recording material which is set under the second position while reversing the second recording material in a U shape, and a path forming member for guiding the reversed, another recording material to the linear path after the recording material is bypassed above the second position.

4 Claims, 13 Drawing Sheets

RECORDING APPARATUS

BACKGROUND

1. Technical Field

The present invention relates to a recording apparatus which is typified by a printer, a facsimile, or a copier, and which includes a recording execution unit having a recording head, a U-shaped reversal path that guides a first recording material such as recording sheet to the recording execution unit while reversing the recording material in a U shape, and a reciprocating movement path that reciprocates a holding tray mounting thereon a second recording material such as an optical disk to be guided to the recording execution unit.

2. Related Art

An ink jet printer will be described as an example of a recording apparatus. Among ink jet printers, there is known a printer having a structure capable of selectively executing a recording operation on both a soft recording material without self-supporting properties such as paper or film and a hard recording material having self-supporting properties such as an optical disk (e.g., CD-R and DVD-R) (reference should be made to, for example, JP-A-2005-059584). The optical disk is transported in a state of being set on a special holding tray.

Moreover, among the ink jet printers, there is known a printer having a U-shaped reversal structure in which a number of sheets are accommodated in a feed cassette in a stacked state and are transported to the front side while being reversed in a U-shaped reversal path which is provided in a rear interior space of a printer body. In the printer having the U-shaped reversal structure, recording heads are arranged in the U-shaped reversal path so that a recording operation is executed on the sheet being transported and reversed in a U shaped state.

However, in the former printer (disclosed in JP-A-2005-059584, for example), since a transport path of the soft recording material and a transport path of the hard recording material are configured to be independent from each other, the printer is likely to become bulky. Particularly, such a problem becomes prominent in a structure that incorporates the holding tray in the printer body.

On the other hand, the latter printer having the U-shaped reversal structure has a structure in which a recording operation is executed on a sheet being transported and reversed in the U-shaped state. In a state where the sheet is reversed in a U-shape, since a backward tension or the like is applied thereto in response to the reversion and curving thereof, a transport load increases, making it difficult to perform highly accurate recording and thus degrading the recording quality.

SUMMARY

An advantage of some aspects of the invention is that it provides a recording apparatus which is excellent in compactness and recording quality thereof.

According to an aspect of the invention, there is provided a recording apparatus including: a recording head; a holding tray on which a first recording material is set and which is configured to be advanced and retracted in a linear path between a first position wherein it opposes the recording head and a second position wherein it is retracted from the first position; a reverse transporting portion for transporting a second recording material which is set under the second position while reversing the second recording material in a U shape; and a path forming member for guiding the reversed, another recording material to the linear path after the recording material is bypassed above the second position.

In the above aspect of the recording apparatus, the path forming member may be integrally formed with a support portion for supporting the holding tray at the second position.

In the above aspect of the recording apparatus, a front end portion of the holding tray being retracted to the second position may protrude to a position located between the linear path and a guide path formed by the path forming member.

In the above aspect of the recording apparatus, the recording apparatus may further include a pivoting flap which is provided at a converging position of the linear path and the guide path formed by the path forming member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a recording apparatus according to an embodiment of the invention will be described. First, an ink jet printer 1 will now be described as a recording apparatus according to an exemplary embodiment of the invention and the schematic entire structure of the printer will be described below with reference to the drawings.

Figure 1:
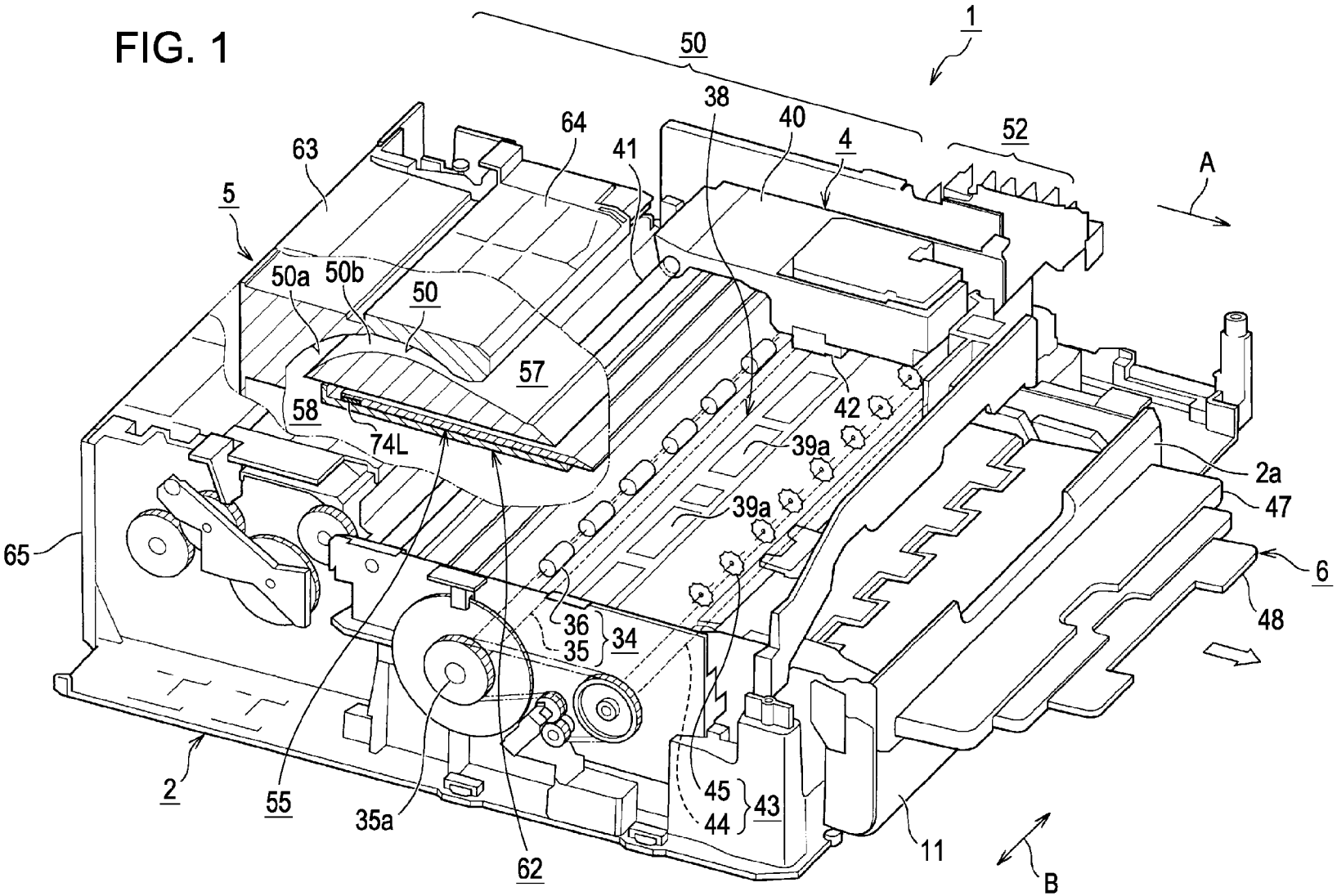
FIG. 1 is a perspective view showing an internal structure of an ink jet printer according to an embodiment of the invention.
Figure 2:
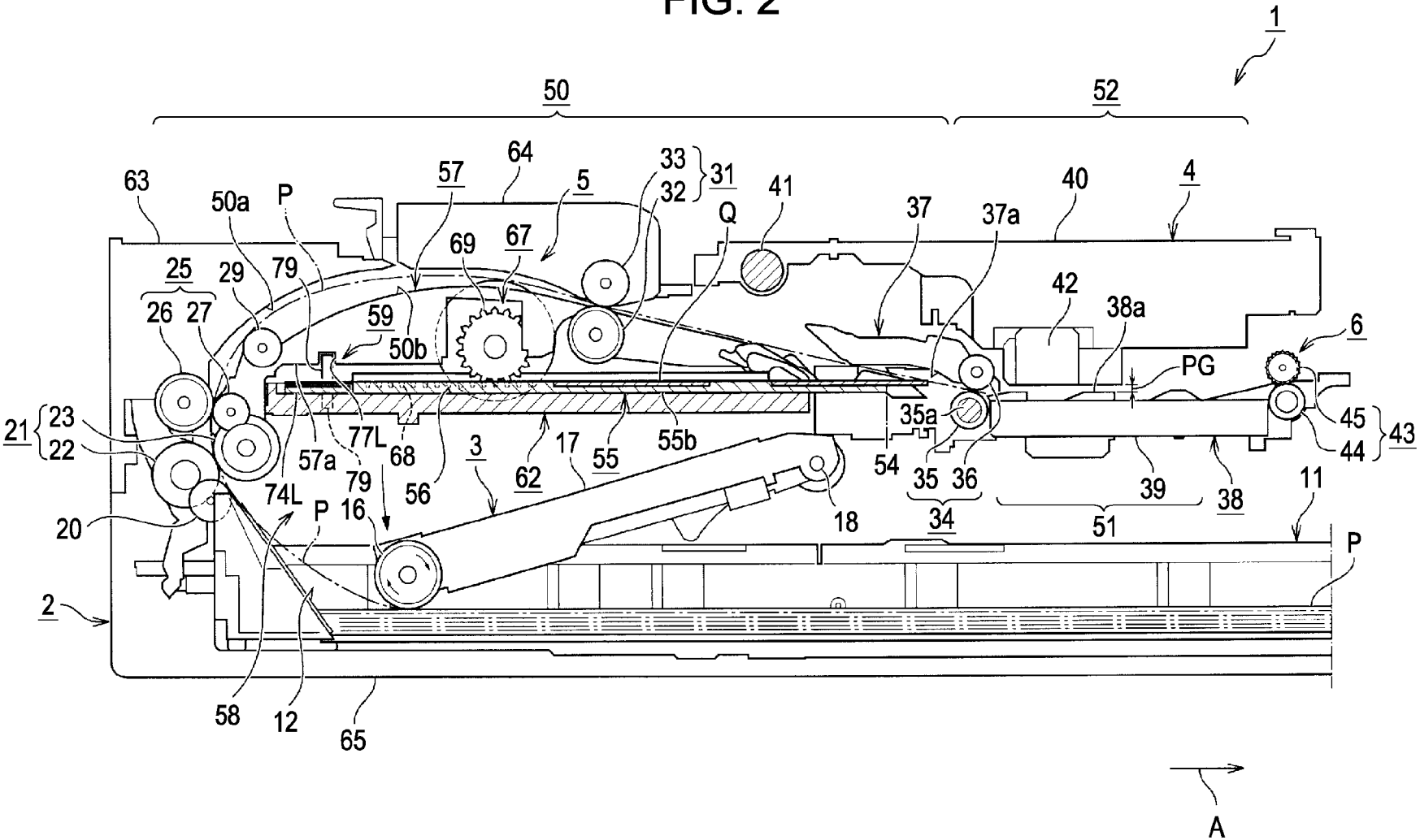
FIG. 2 is a side sectional view of the ink jet printer when a holding tray is received therein.
Figure 3:
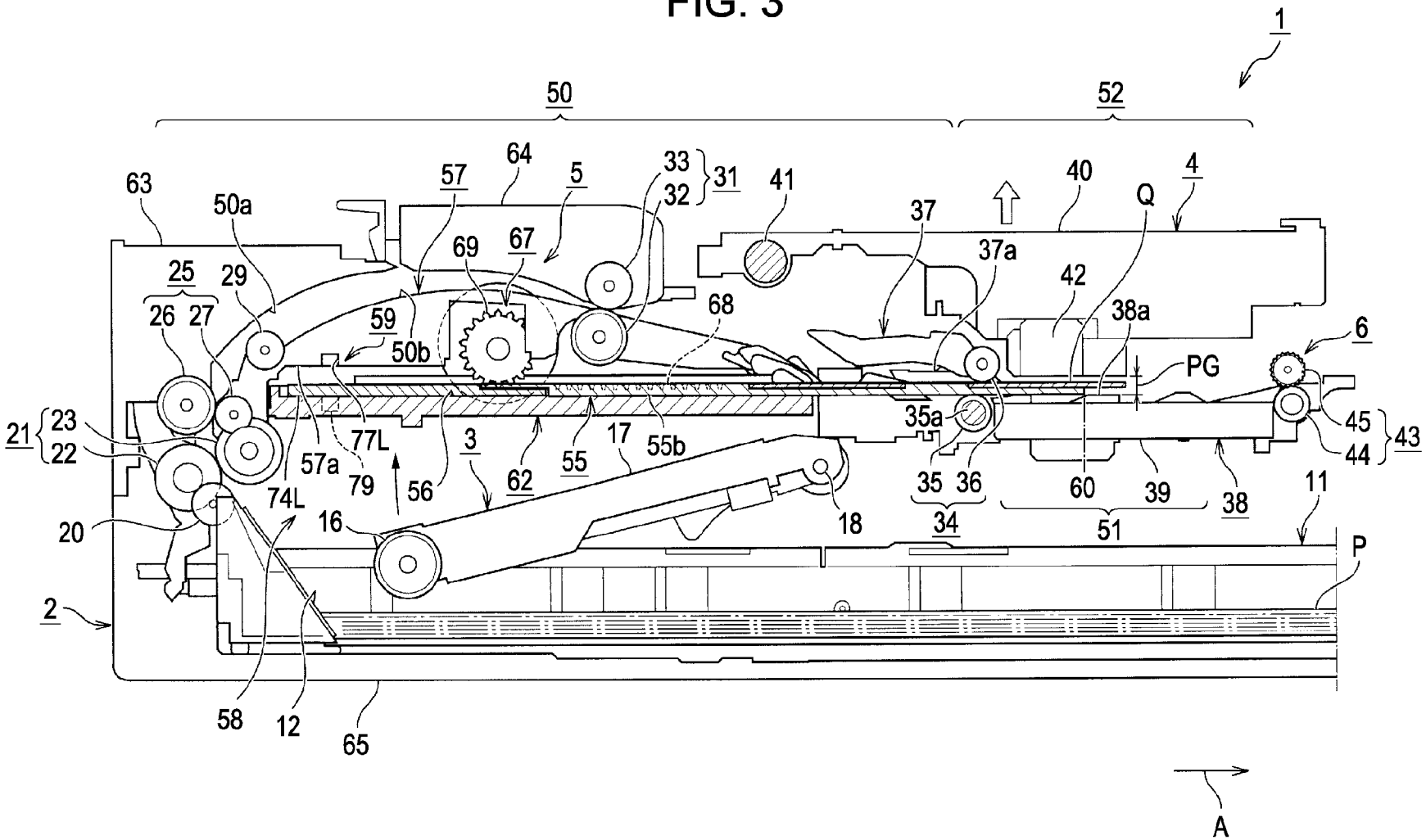
FIG. 3 is a side sectional view of the ink jet printer at the start of execution of a previous recording operation.
Figure 4:
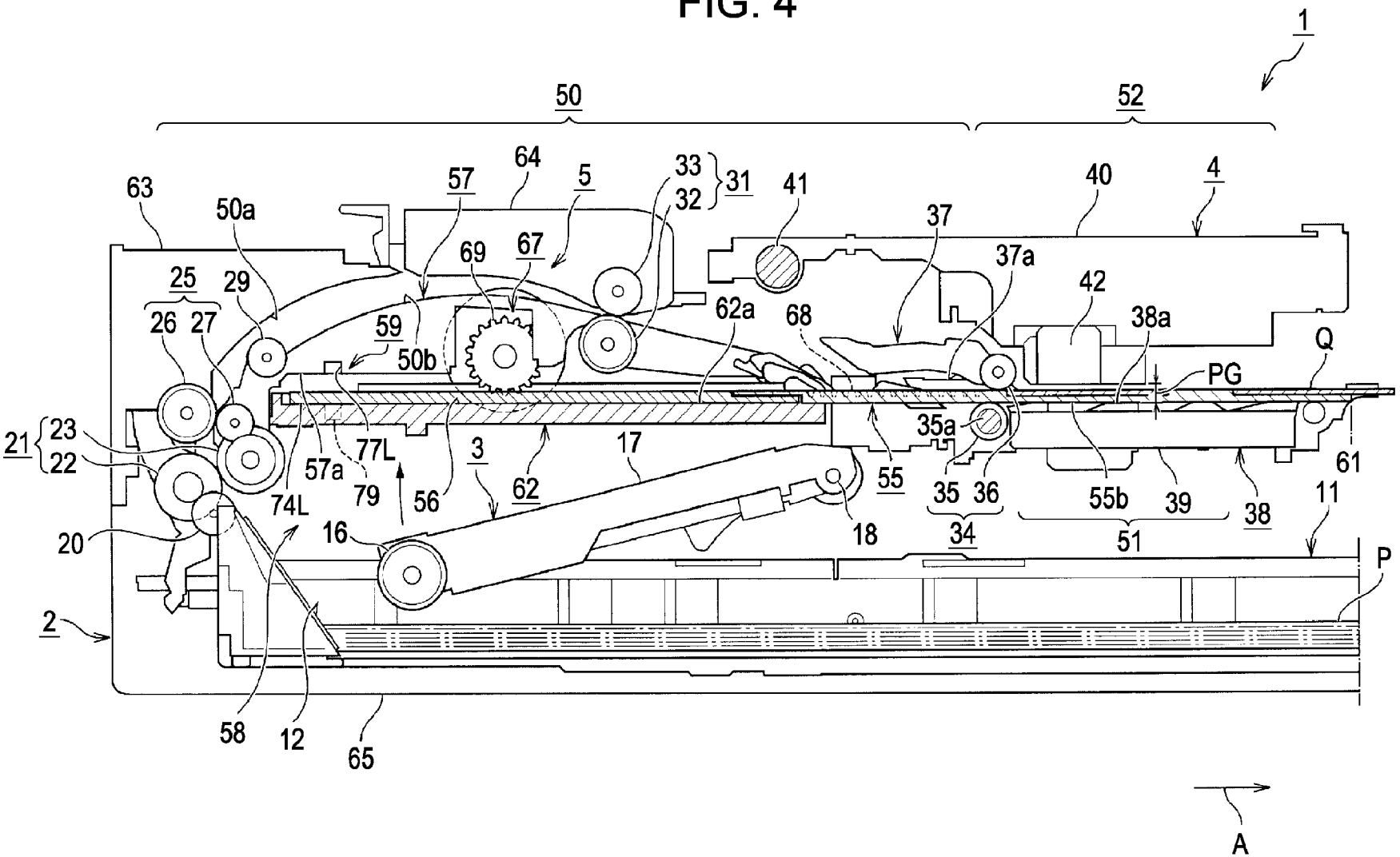
FIG. 4 is a side sectional view of the ink jet printer at the end of execution of a previous recording operation.
Figure 5:
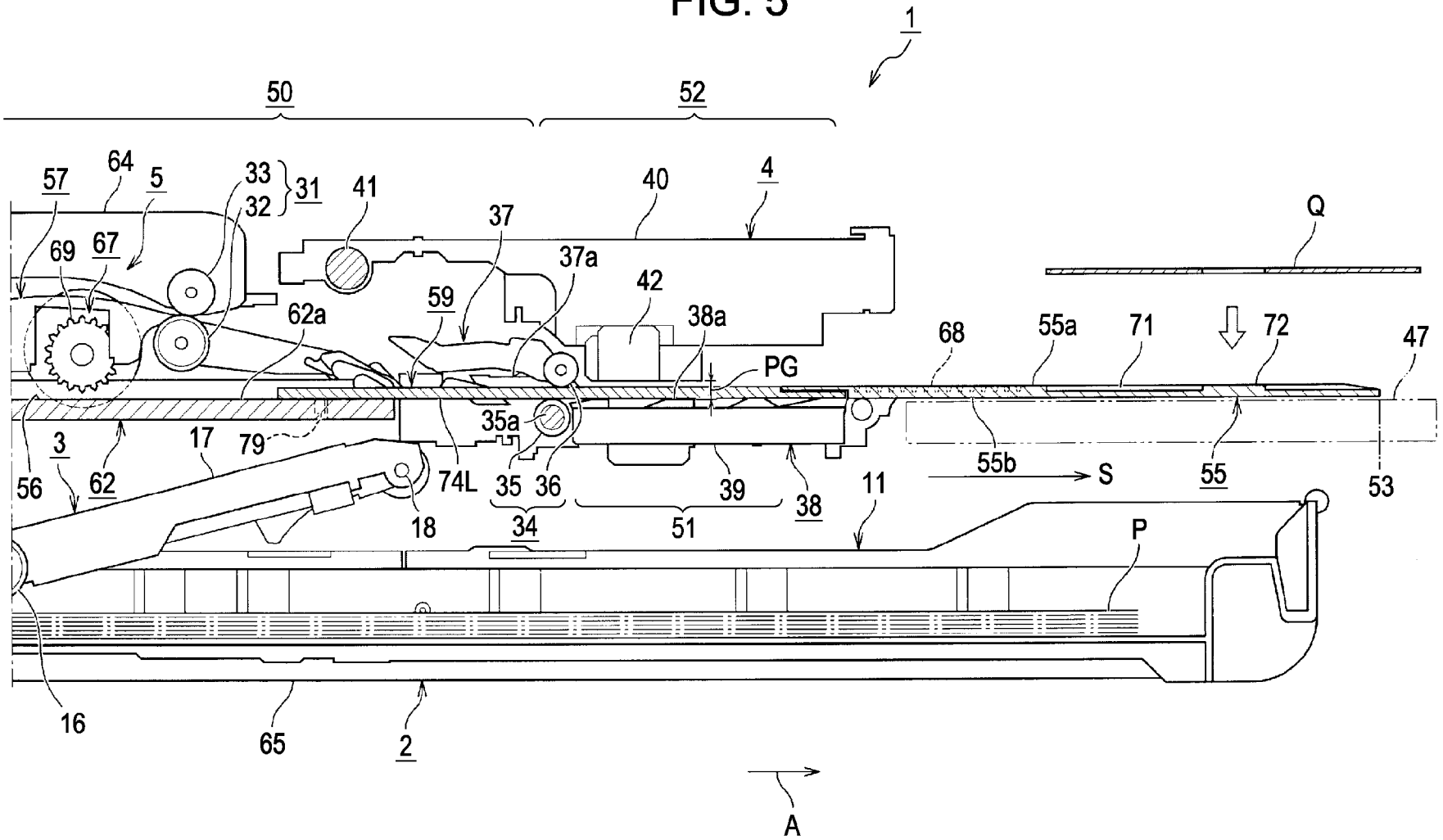
FIG. 5 is a side sectional view of the ink jet printer when a second recording material is set thereon.

FIG. 1 is a perspective view showing an internal structure of an ink jet printer, and FIG. 2 is a side sectional view showing a schematic internal structure of the ink jet printer when a holding tray is positioned at a storage position thereof. FIG. 3 is a side sectional view of the ink jet printer when the holding tray is positioned at a recording execution start position thereof, and FIG. 4 is a side sectional view of the ink jet printer when the holding tray is positioned at a recording execution ending position thereof. FIG. 5 is a side sectional view of the ink jet printer when the holding tray is positioned at a set position thereof.

The ink jet printer 1 is a multi-functional ink jet printer, on which a not-shown image reading device (scanner) is mounted, and is a such a type of ink jet printer that is capable of executing a recording operation on both a first recording material P, which is a soft recording material such as sheet or film, and a second recording material Q which is a hard recording material such as an optical disk including CD-R and DVD-R. The ink jet printer 1 is a serial printer in which a recording head 42 is mounted on a lower surface of a carriage 40 which is capable of reciprocating along a width direction B intersecting a transport direction A, the lower surface corresponding to a recording execution region of the two kinds of first and second recording materials P and Q.

The ink jet printer 1 is provided with a printer body 2 which is a recording apparatus main body having a rectangular casing shape and has an external appearance configured by a relatively flat surface. Moreover, a feed cassette 11 capable of accommodating therein a number of first recording materials P in a stacked state is detachably attached to a central lower portion of a front surface 2*a* of the printer body 2. Furthermore, a discharge stacker 47 for stacking the first recording material P having data or images recorded thereon in a stacked state is provided above the mounting surface of the feed cassette 11. In addition, on the front surface 2*a* of the printer body 2, not-shown operation buttons for execution of various operation instructions, not-shown cartridge holders for receiving therein various ink cartridges, and the like are provided.

The feed cassette 11 is a member which is installed at a beginning position of the transport path of the first recording material P. The first recording materials P accommodated in the feed cassette 11 are sequentially and continuously fed out on a one-by-one basis from the uppermost one by an automatic feeding device 3 to be fed toward a later-described U-shaped reversal path 50. The automatic feeding device 3 is configured to include a pickup roller 16 that rearwardly draws an upper one of the first recording material P in the feed cassette 11, a sloped separation surface 12 that guides the upper one of the first recording material P, which is drawn rearward, to the U-shaped reversal path 50, while preliminarily separating the first recording material, a first guide roller 20 which is provided obliquely above a rear portion of the sloped separation surface 12 in a freely rotatable state, and a separation roller 21 which is provided obliquely above a rear portion of the first guide roller 20.

The pickup roller 16 is provided at a front end portion of a pivot arm 17 which pivots about a pivot shaft 18 so as to make pressure contact with an upper surface of the first recording material P during feeding thereof, whereby the upper one of the first recording material P in the feed cassette 11 is drawn rearward by its rotation in the transport direction A. The separation roller 21 is applied with a predetermined rotational resistance by a torque limiter mechanism and is configured by a pair of nip rollers of a driven separation roller 22 and a driving separation roller 23. The separation roller 21 performs a main separation operation that completely separates a subsequent one of the first recording material P, which was unable to separate in the preliminarily separation by the sloped separation surface 12, from the uppermost one of the first recording material P.

The first recording material P fed to the U-shaped reversal path 50 is transported on the U-shaped reversal path 50 by a later-described recording-material feeding device 5 according to the present embodiment to be guided to a recording position 51. Under the recording position 51, a platen 38 is provided which supports the lower surface of the first recording material P or the second recording material Q, which is transported thereto, to thereby define a gap PG between the recording material and the lower surface of the recording head 42. The platen 38 is configured to include a transport guide portion 39 which is a support member, platen ribs 38*a* which are formed on an upper surface of the transport guide portion 39, and ink recovery grooves 39*a* for recovering surplus ink which was not used for execution of a recording operation.

On the other hand, above the recording position 51, there are provided the recording head 42 which is a major constituent element of the recording execution device 4 which is a recording execution unit, and the carriage 40 which is capable of reciprocating while being guided in the width direction B along a carriage guide shaft 41 in a state of mounting the recording head 42 on a lower surface thereof. The recording execution device 4 is configured to include a plurality of not-shown, ink tubes and ink supply pumps for supplying ink of each color to the recording head 42, a not-shown capping device which is provided at the home position of the carriage 40, a not-shown automatic gap adjustment mechanism which is used, for example, when switching between the first recording material P and the second recording material Q, and the like. The recording head 42 is provided on a planar transport path 52 which is disposed in the vicinity of a downstream position of a later-described transport roller 34.

At a downstream position of the recording position 51, a recording-material discharge device 6 is provided. The recording-material discharge device 6 is configured to include a discharge roller 43 which is configured by a pair of nip rollers of a driving discharge roller 44 and a driven discharge roller 45 and the above-described discharge stacker 47. In the discharge stacker 47, an extension stacker 48 which is accommodated therein in a nested shape is provided so as to be freely drawn out or received therein.

Embodiment

Next, the ink jet printer 1 according to the present embodiment, having such a configuration, will be described in detail with reference to the drawings.

Figure 6:
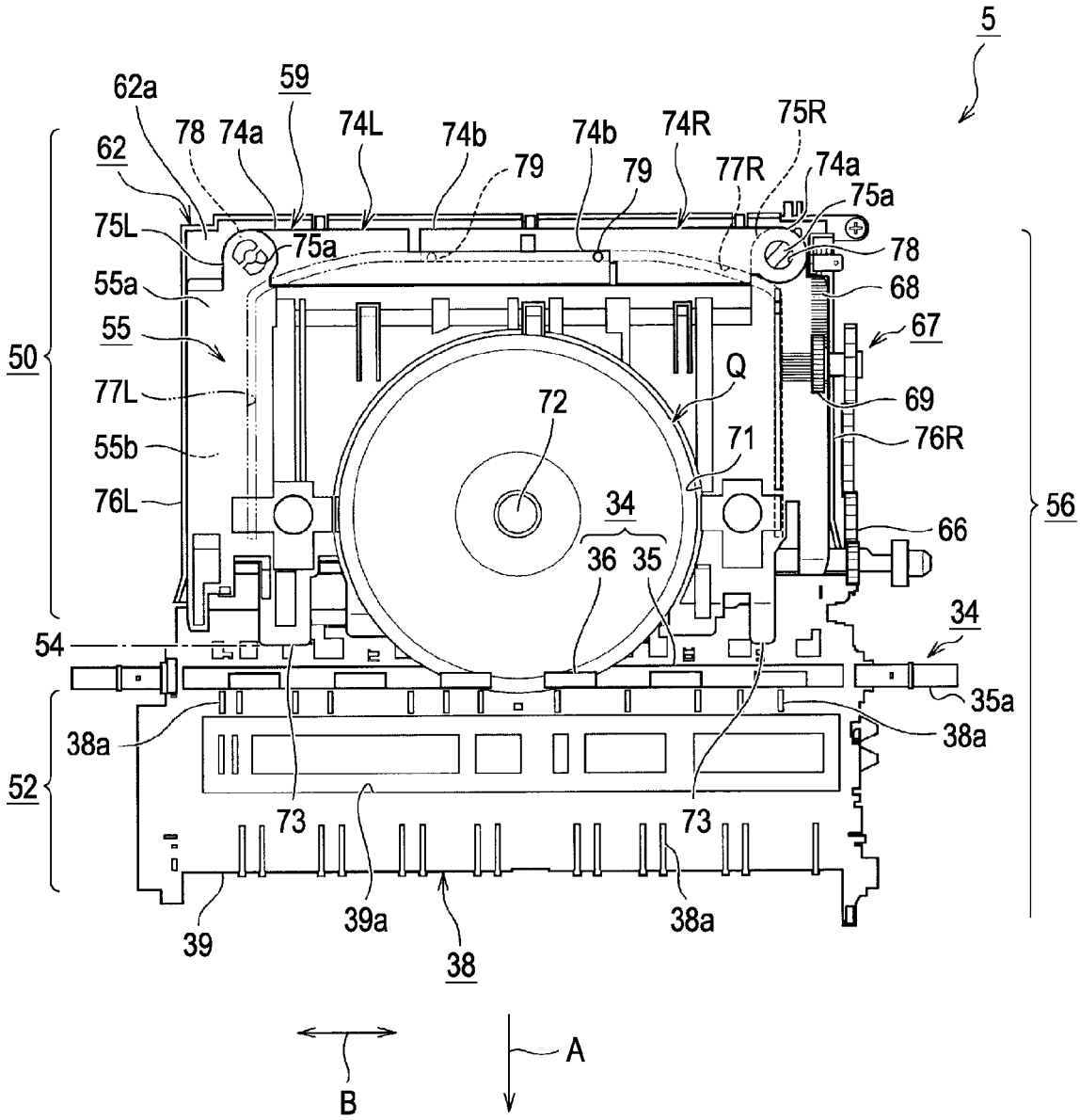
FIG. 6 is a top plan view showing an operation state of the holding tray on a reciprocating movement path of the holding tray when the holding tray is positioned at a storage position thereof.
Figure 7:
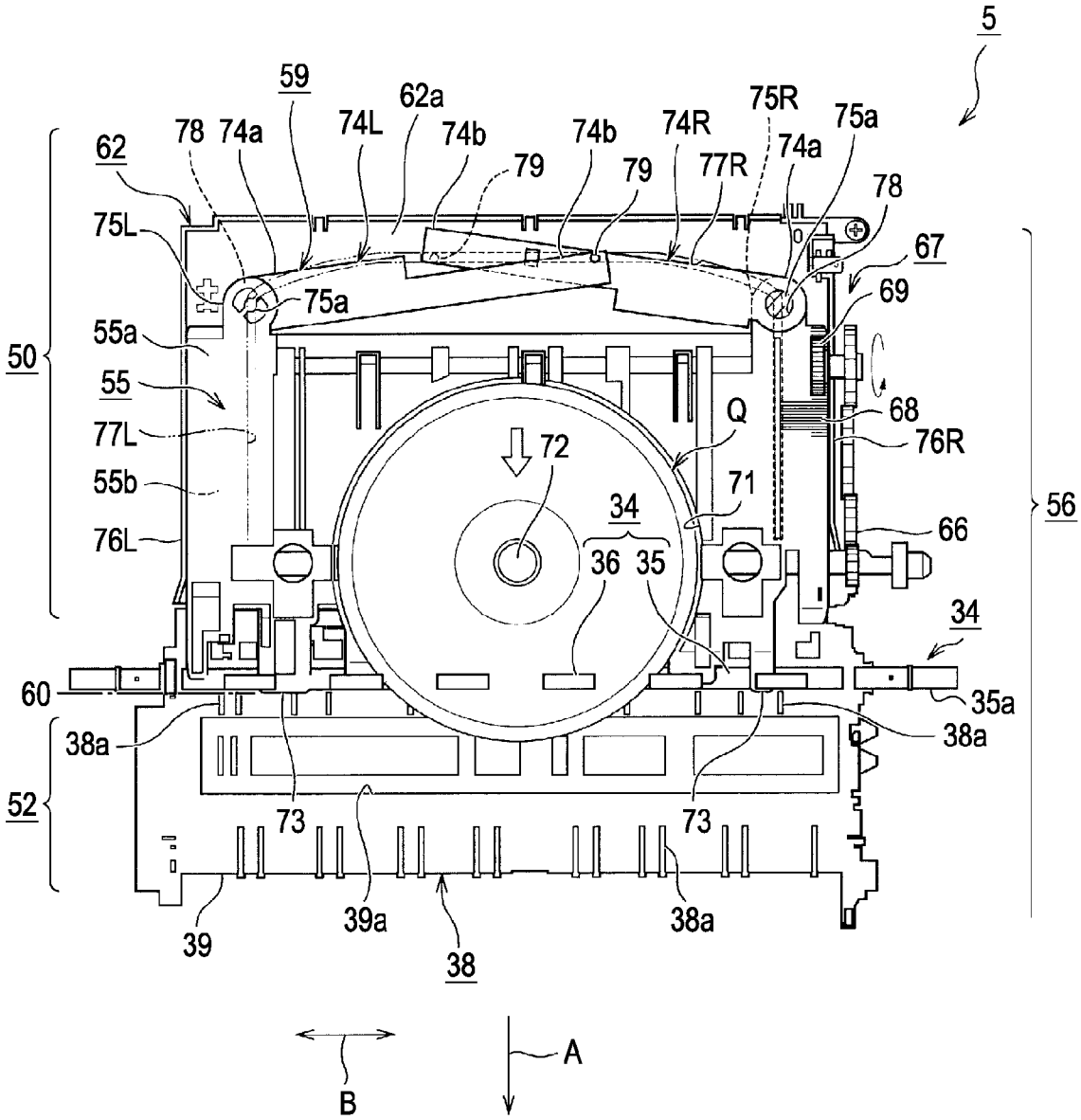
FIG. 7 is a top plan view of the holding tray at the start of execution of a previous recording operation.
Figure 8:
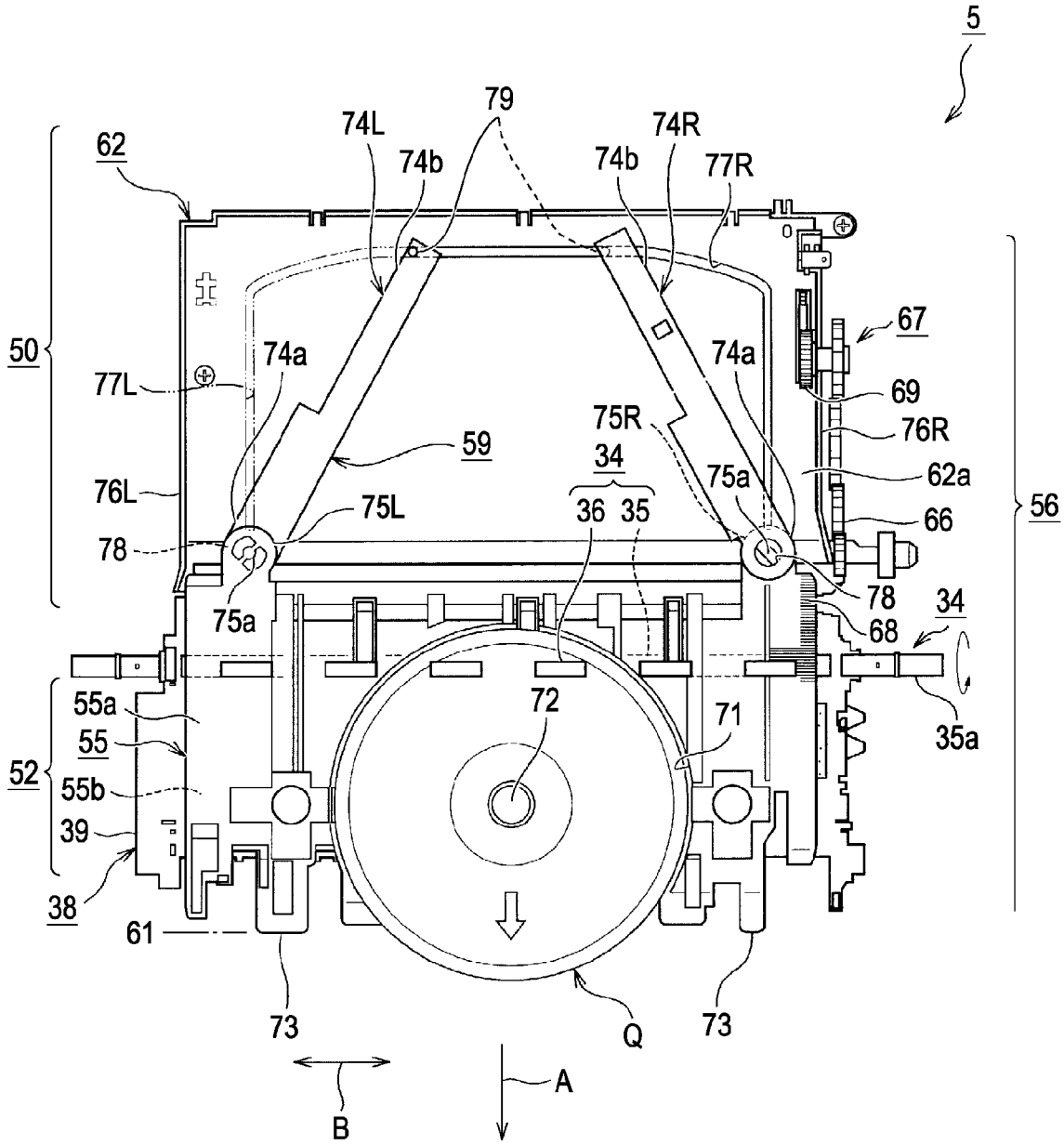
FIG. 8 is a top plan view of the holding tray at the end of execution of a previous recording operation.
Figure 9:
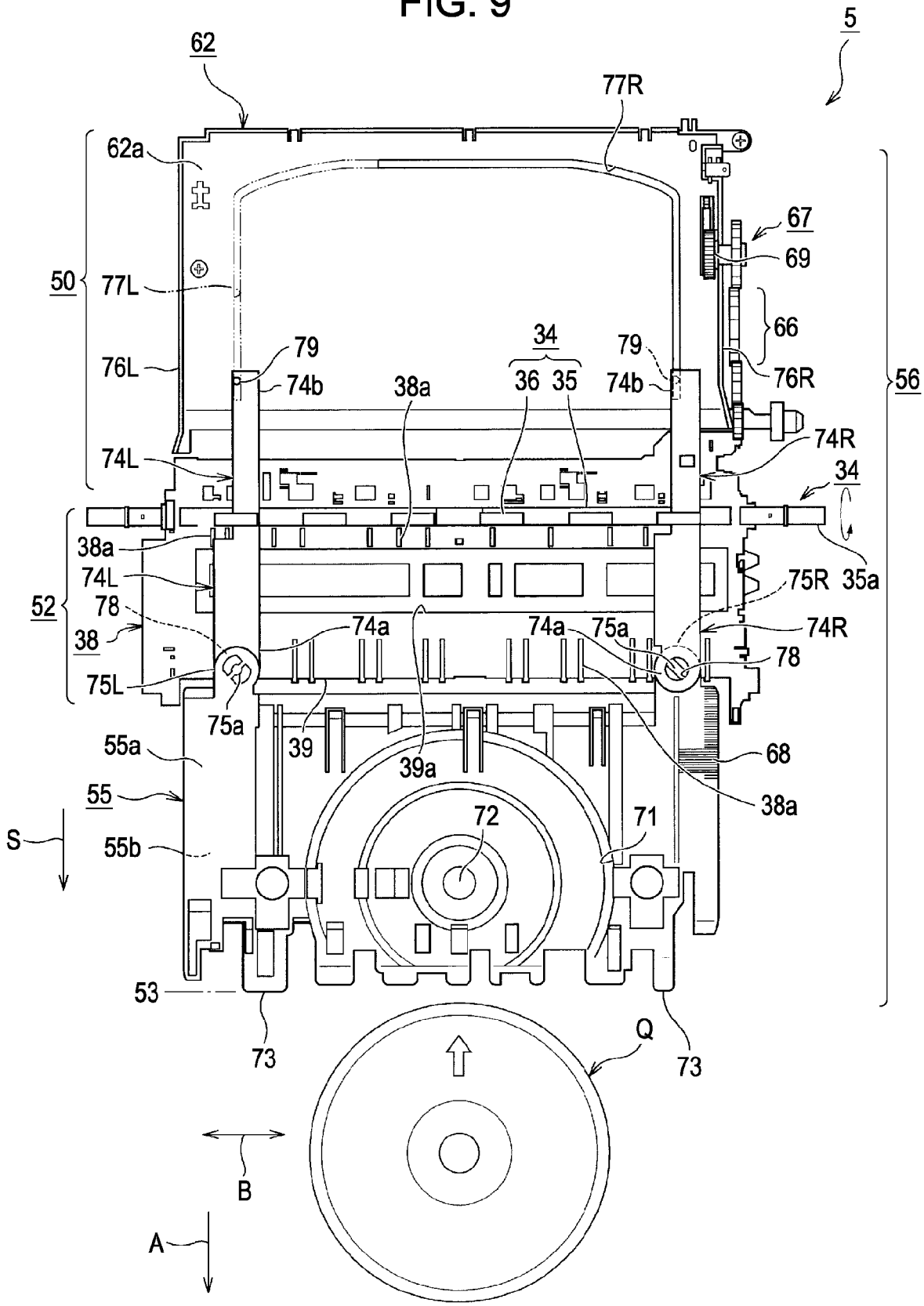
FIG. 9 is a top plan view of the holding tray when a second recording material is set thereon.
Figure 10:
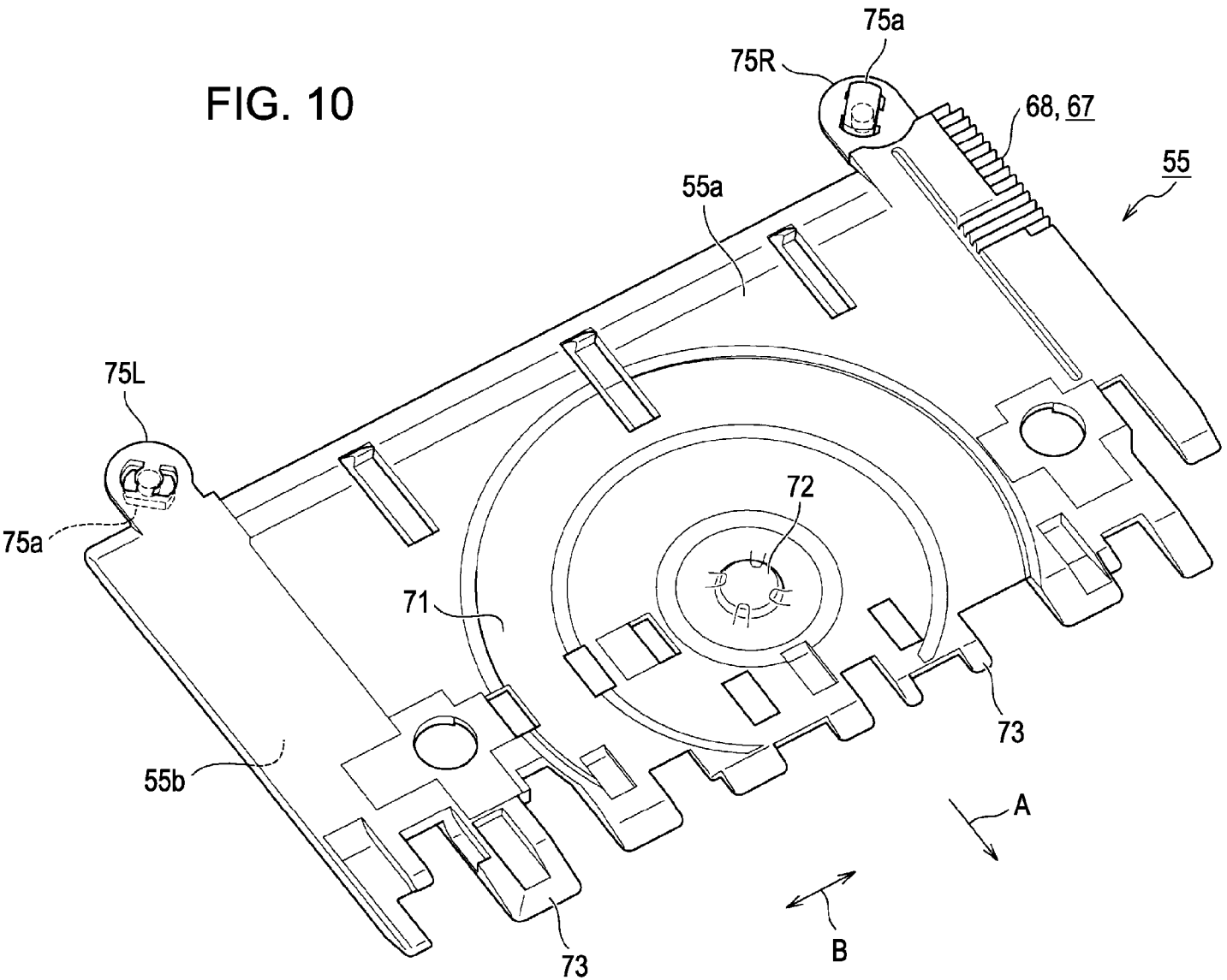
FIG. 10 is an upper perspective view of the holding tray.
Figure 11:
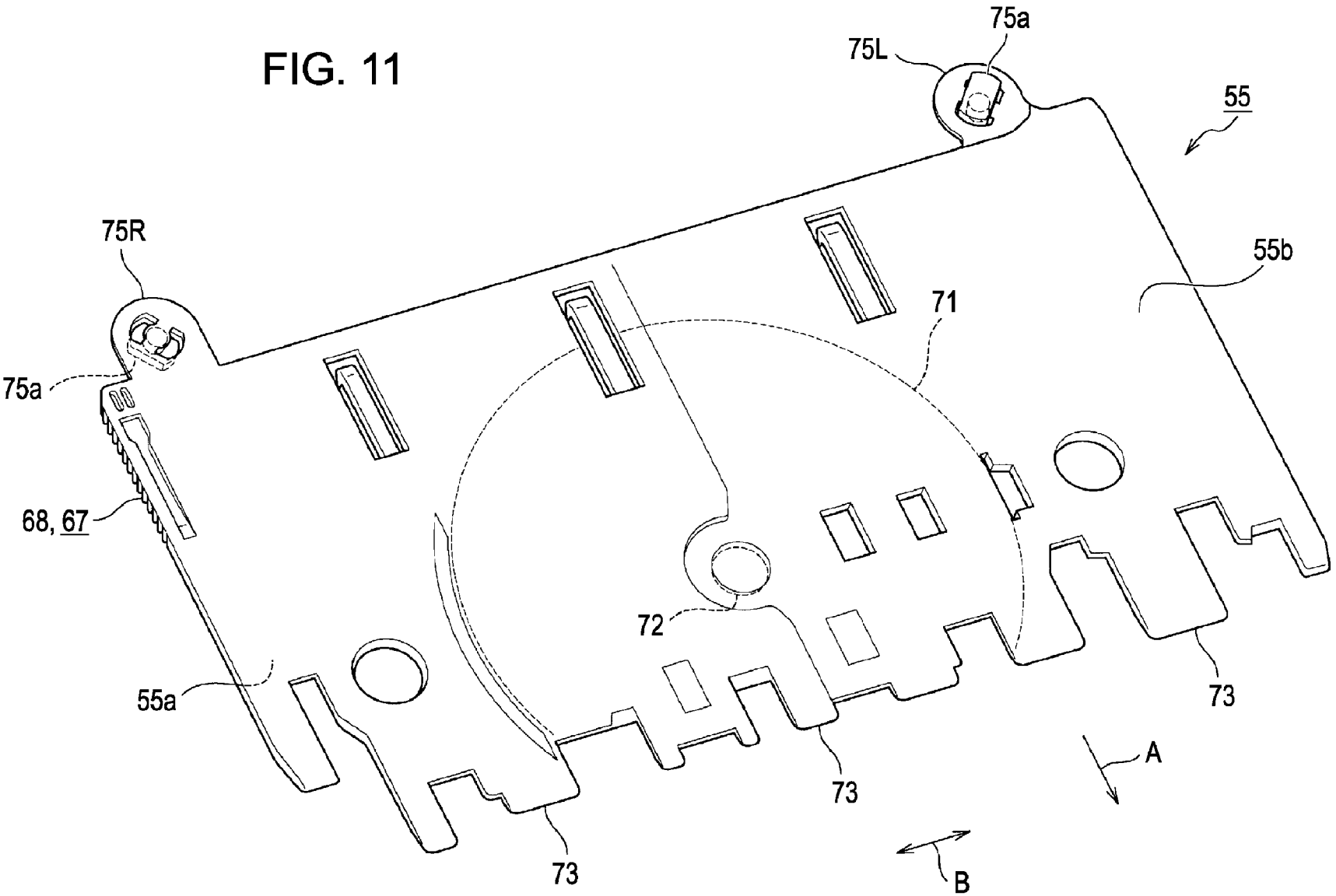
FIG. 11 is a lower perspective view of the holding tray.
Figure 12:
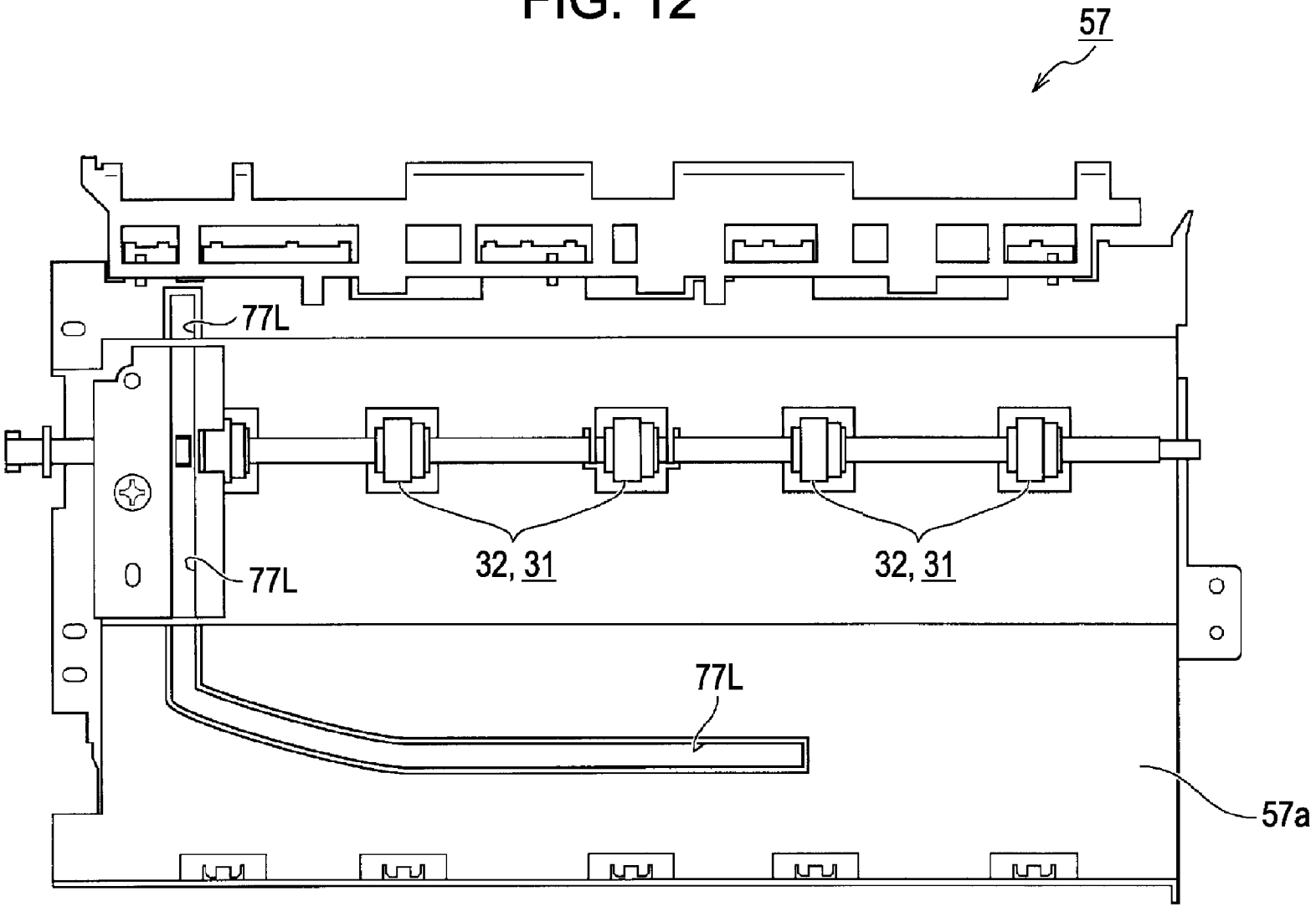
FIG. 12 is a bottom plan view of a path forming member.
Figure 13:
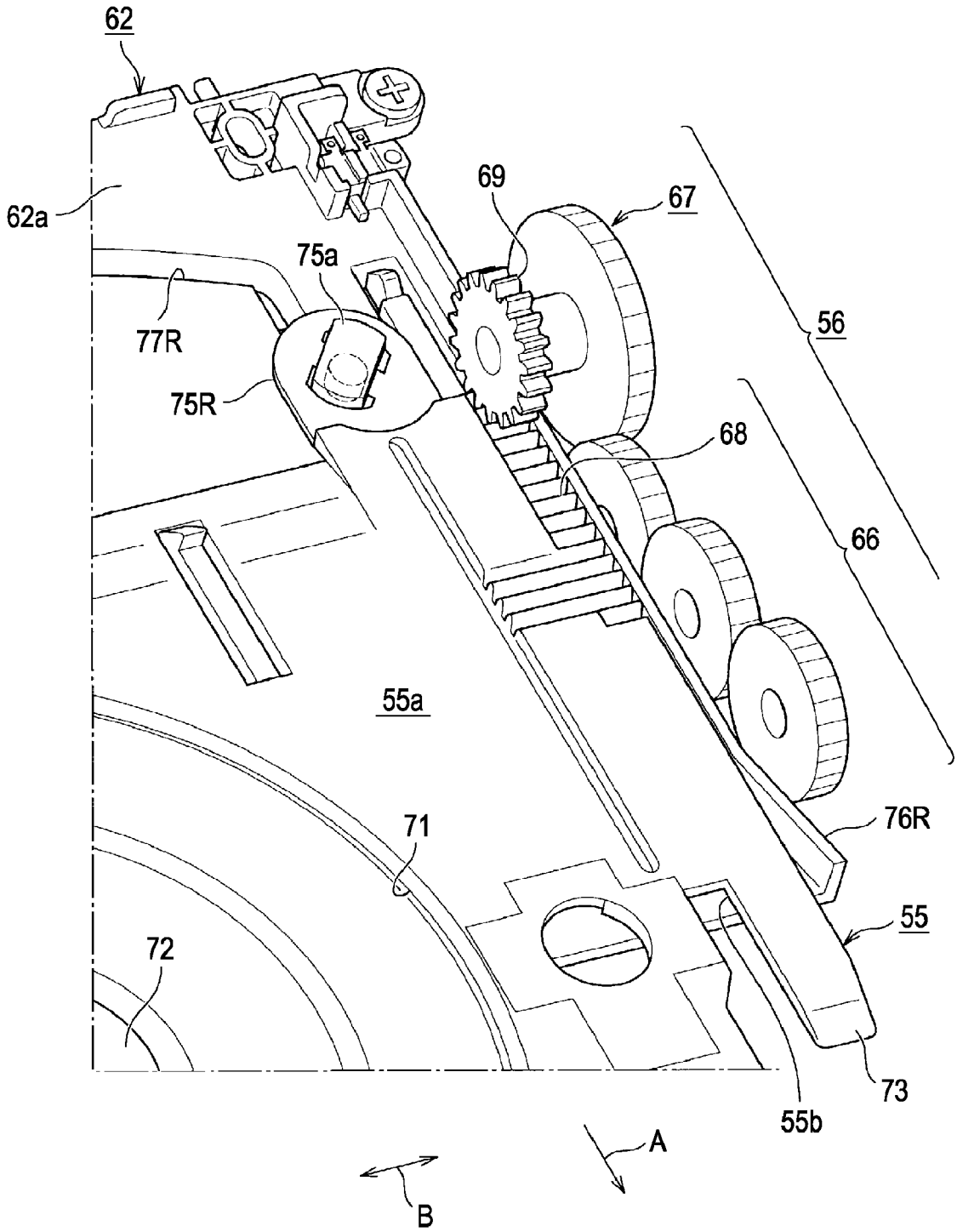
FIG. 13 is a perspective view of an auxiliary transport mechanism of the holding tray.

FIG. 6 is a top plan view showing an operation state of the holding tray on a reciprocating movement path of the holding tray when the holding tray is positioned at a storage position thereof, and FIG. 7 is a top plan view of the holding tray when the holding tray is positioned at the recording execution start position. FIG. 8 is a top plan view of the holding tray when the holding tray is positioned at the recording execution ending position, and FIG. 9 is a top plan view of the holding tray when the holding tray is positioned at the set position. FIG. 10 is an upper perspective view of the holding tray, and FIG. 11 is a lower perspective view of the holding tray. FIG. 12 is a bottom plan view of the path forming member, and FIG. 13 is a perspective view of an auxiliary transport mechanism of the holding tray.

The ink jet printer 1 according to the present embodiment is provided with the feed cassette 11 which is detachably attached to the printer body 2, the U-shaped reversal path 50 which guides the first recording material P stacked in the feed cassette 11 to be discharged to the front surface 2*a* of the printer body 2 which is the mounting surface of the feed cassette 11 by reversing the recording material in a U shape, the holding tray 55 which is capable of moving between a set position 53 (FIGS. 5 and 9) and a storage position 54 (FIGS. 2 and 6) in a state where the second recording material Q is set thereon, a reciprocating movement path 56 which guides the reciprocating movement of the holding tray 55 between the set position 53 and the storage position 54, and the transport roller 34 which is provided at the downstream position of the U-shaped reversal path 50 so as to transport the first and second recording materials P and Q.

In the present embodiment, in addition to the above-described configuration, the holding tray 55 is configured by a tray having such a small size that it can be received within an interior space 58 of the path forming member 57 which forms the U-shaped reversal path 50, and an extending movement mechanism 59 that extends the movement stroke S in order to guide the holding tray 55 to the set position 53 is connected to the holding tray 55. At the downstream position of the U-shaped reversal path 50, the planar transport path 52 capable of transporting the first and second recording materials P and Q in a planar posture is provided, and as described above, the recording position 51 is provided on the planar transport path 52 in the vicinity of the downstream position of the transport roller 34.

The recording position 51 as used in the present specification means a recording execution region where a recording operation is performed by the recording head 42. Specifically, the recording position corresponds to a recording execution region having a gap defined between the recording execution start position 60 shown in FIG. 7 and the recording execution ending position 61 shown in FIG. 8.

As a characteristic configuration of the present embodiment, in the interior space 58 of the path forming member 57, a support member 62 for supporting the rear surface (lower surface) 55*b* of the holding tray 55 positioned at the storage position 54 is provided in a state of being integral with the path forming member 57. This integral structure may be any of an integral structure by integral molding of plastic material and an integral structure in which individual bodies are fixed by a fixing tool.

According to the present embodiment, since the support member 62 for supporting the rear surface 55*b* of the holding tray 55 positioned at the storage position 54 is provided within the interior space 58 of the path forming member 57 to be integral with the path forming member 57, it is possible to increase the mechanical strength of the path forming member 57 which forms the U-shaped reversal path 50 and the recording apparatus main body.

The U-shaped reversal path 50 is provided by using the rear interior space of the printer body 2. The U-shaped reversal path 50 is configured to include upper housings 63 and 64 which are divided into two parts and positioned on the upper side, an upper transport guide 37, the upper housings 63 and 64 and the upper transport guide 37 being examples of members forming an outer guide surface 50*a* of the U-shaped reversal path 50, a lower housing 65 which is disposed on the lower side, and the path forming member 57 that forms an inner guide surface 50*b* of the U-shaped reversal path 50. On the U-shaped reversal path 50, as shown in FIG. 2, a first intermediate conveying roller 25 which is configured by a pair of nip rollers of a driving conveying roller 26 and a driven conveying roller 27, a second guide roller 29 which is configured to be freely rotatable, and a second intermediate conveying roller 31 which is configured by a pair of nip rollers of a driving conveying roller 32 and a driven conveying roller 33 are arranged. By the conveying and guiding operation of these rollers 25, 29 and 31, the first recording material P supplied to be positioned in the U-shaped reversal path 50 is supplied to the above-described transport roller 34 provided in the vicinity of the downstream position of the U-shaped reversal path 50.

The transport roller 34 is configured by a pair of nip rollers of a driving transport roller 35 which is supported by a roller driving shaft 35*a* and a driven transport roller 36 which is provided at a front end of the upper transport guide 37 in a freely rotatable state. The position of the driven transport roller 36 in the transport direction A is set to a position which is shifted slightly downstream from the position of the driving transport roller 35 in the transport direction A. By employing the transport roller 34 having such position setting, a front end of the first recording material P supplied thereto is pressed by the platen ribs 38*a* disposed thereunder, and thus it is possible to prevent the first recording material P from being scratched by the head, thereby achieving improvement in the recording quality. Moreover, driving force from a not-shown driving motor is transmitted to the roller driving shaft 35*a*, thereby transporting the first and second recording materials P and Q. In addition, the driving force is transmitted to an auxiliary transport mechanism 67 via a gear train 66, whereby a movement start operation wherein the second recording material Q starts moving from the storage position 54 and a movement end operation wherein the second recording material Q reaches the storage position 54 can be executed.

Furthermore, a not-shown clutch device is provided in the roller driving shaft 35*a*, so that by appropriately changing the engagement position of the clutch device, the driving force of the roller driving shaft 35*a* can be selectively transmitted to the above-described, not-shown ink supply pump, capping device, and automatic gap adjustment mechanism, and the automatic feeding device 3.

The holding tray 55 is a rectangular flat plate-like member having a small depth dimension as shown in FIGS. 10 and 11. At positions of an upper surface 55*a* of the holding tray 55 located slightly frontward from the central position in the width direction thereof, a concave setting portion 71 for setting the second recording material Q and a convex holding portion 72 for holding the second recording material Q being set at the center thereof are formed. Applicable examples of the second recording material Q which can be set on the holding tray 55 include a variety of optical disks including one that will be developed in the future, such as CD-R, CD-RW, DVD-R, DVD-RW having a diameter of 12 or 8 cm or a blu-ray disk that is attracting attentions as a next-generation optical disk.

In addition, guide claws 73 which have a comb-teeth shape and are downwardly sloped toward the front side are formed at the front end portion of the holding tray 55. In the vicinity of the corner portions of the rear end portion of the holding tray 55, tongue-like connection pieces 75L and 75R are formed so as to be rotatably connected to front end portions 74*a* and 74*a* of later-described guide arms 74L and 74R of the extending movement mechanism 59. Moreover, convex connection portions 75*a* are formed on the lower surface of the left connection piece 75L and the upper surface of the right connection piece 75R.

The reciprocating movement path 56 is configured to include the above-described support member 62 that supports the lower surface of the holding tray 55 when the holding tray 55 is positioned at the storage position 54, edge guides 76L and 76R which are provided to the support member 62 so as to make sliding contact with left and right side edges of the holding tray 55, thereby guiding the movement of the holding tray 55, the above-described transport guide portion 39 that supports the lower surface of the holding tray 55 when the holding tray 55 is positioned at the recording position 51, and the above-described discharge stacker 47 that supports the lower surface of the holding tray 55 when the holding tray 55 is positioned at the set position 53.

The extending movement mechanism 59 is configured to include the folding-type guide arms 74L and 74R which are rotatably connected to the holding tray 55, and guide rails 77L and 77R which are configured to engage with the proximal end portions 74*b* of the guide arms 74L and 74R to thereby guide the posture and movement of the guide arms 74L and 74R. The guide arms 74L and 74R are elongated, flat plate-like members having a small width, and connection holes 78 and 78 are formed on the front end portions 74*a* of the guide arms 74L and 74R so as to rotatably connect the guide arms 74L and 74R to the connection pieces 75L and 75R of the holding tray 55.

Moreover, guide pins 79 and 79 are provided on the proximal end portions 74*b* of the guide arms 74L and 74R so as to upwardly project from the left guide arm 74L and downwardly project from the right guide arm 74R, respectively. The guide pin 79 upwardly projecting from the guide arm 74L is configured to engage with the L-shaped guide rail 77L that is formed on an inner circumferential surface 57*a* of the path forming member 57, and the guide pin 79 downwardly projecting from the guide arm 74R is configured to engage with the L-shaped guide rail 77R that is formed horizontally symmetrically on an upper surface 62*a* of the support member 62.

The movement of the holding tray 55 in the transport direction A and the direction opposite to the transport direction A is carried out by the above-described auxiliary transport mechanism 67 and the above-described transport roller 34. The auxiliary transport mechanism 67 carries out the movement wherein the holding tray 55 positioned at the storage position 54 is transferred to the recording execution start position 60 and the movement wherein the holding tray 55 positioned at the recording execution start position 60 is stored at the storage position 54. As an example of the auxiliary transport mechanism 67, a rack and pinion mechanism as shown in an enlarged view in FIG. 13 can be applied. In the present embodiment, the auxiliary transport mechanism 67 is illustrated in which a rack 68 is arranged at the rear right edge portion of the upper surface 55*a* of the holding tray 55 and a pinion 69 is arranged at a terminating end portion of the gear train 66 transmitting the driving force of the roller driving shaft 35*a*, respectively.

Next, the operation state of the recording apparatus according to the present embodiment, having such a configuration will be described by dividing the operation with respect to the holding tray into: (1) during storage; (2) at the start of execution of recording operation; (3) at the end of execution of recording operation; and (4) during setting.

(1) During Storage (FIGS. 2 and 6)

During storage refers to a case where the holding tray 55 is positioned at the storage position 54. In this case, as shown in the drawings, the holding tray 55 is stored within the U-shaped reversal path 50 in a state in which the lower surface 55*b* is supported by the support member 62 in the interior space 58 of the path forming member 57.

When the holding tray 55 is positioned at the storage position 54, as shown in FIG. 2, it is able to execute a recording operation on the first recording material P. That is, only the uppermost one of the first recording material P among the first recording materials P accommodated in the feed cassette 11 is supplied to the U-shaped reversal path 50 by the automatic feeding device 3. In the U-shaped reversal path 50, a conveying force is applied to the first recording material P by the first intermediate conveying roller 25 and the second intermediate conveying roller 31 and is guided to the transport roller 34 by the second guide roller 29, the outer guide surface 50*a* and the inner guide surface 50*b* of the U-shaped reversal path 50, and the inner guide surface 37*a* of the upper transport guide 37. Moreover, the first recording material P is transported to the recording position 51 provided on the planar transport path 52 by the pinching and transporting action of the transport roller 34, whereby a desired recording operation is executed thereon by the recording execution device 4.

According to the present embodiment, since the U-shaped reversal path 50 of the first recording material P (another recording material) is formed by bypassing the accommodation space of the holding tray 55, it is possible to realize a recording apparatus which is excellent in compactness and recording quality thereof.

Moreover, since the storage position 54 for incorporating the holding tray 55 in the recording apparatus main body is provided in the interior space 58 of the path forming member 57 that forms the U-shaped reversal path 50, it is possible to effectively utilize the interior space 58 of the U-shaped reversal path 50.

Furthermore, since the recording head 42 that constitutes the recording execution device is provided at a position closer to the set position 53 than the end portion of the holding tray 55 positioned at the storage position 54, disposed close to the set position 53, it is possible to secure a large (long), relatively flat region on the upstream side immediately close to the recording head 42. Owing to such a configuration, it is possible to reduce the transport load resulting from the U-shaped reversion and curving, to perform highly accurate recording, and to prevent degrading in the recording quality. This is particularly advantageous in a recording material having a small height such as a postcard because the reversed and curved state thereof in the U-shaped reversal path 50 is disappeared so that the recording material becomes generally flat and a recording operation can be performed thereon.

In addition, in a state in which the front end of the first recording material P arrives at the transport roller 34 in direct charge of transport of the recording material during execution of an recording operation, since the recording material P on the upstream side thereof is able to assume an approximately flat shape, it is possible to reduce the transport load, to perform highly accurate transport by means of the transport roller 34, and to improve the recording quality.

(2) At the Start of Execution of Recording Operation (FIGS. 3 and 7)

When the driving force of the roller driving shaft 35*a* is transmitted to the rack 68 of the holding tray 55 positioned at the storage position 54 via the gear train 66 and the pinion 69, the holding tray 55 starts moving forward. When the guide claws 73 at the front end of the holding tray 55 reaches the nip point of the transport roller 34, the transmission of the driving force from the auxiliary transport mechanism 67 stops, and the holding tray 55 reaches the recording execution start position 60 wherein it receives the driving force from the transport roller 34. Since the holding tray 55 is used by the second recording material Q, the gap PG between the recording head 42 and the platen 38 is enlarged upward by operating a not-shown automatic gap adjustment device so as to be set to a gap PG for the second recording material Q.

(3) At the End of Execution of Recording Operation (FIGS. 4 and 8)

The holding tray 55 positioned at the recording execution start position 60 is transported on the planar transport path 52 along the transport direction A by the pinching and transporting action of the transport roller 34. At the same time, ink of each color is ejected downward from the recording head 42 over an entire width of the recording surface of the second recording material Q by the reciprocating movement of the carriage 40 reciprocating in the width direction B. When the execution of the recording operation on the recording surface of the second recording material Q ends, the holding tray 55 arrives at the recording execution ending position 61 shown in FIGS. 4 and 8.

(4) During Setting (FIGS. 5 and 9)

When the second recording material Q is set on the holding tray 55 or when the second recording material Q having data or images recorded thereon is removed from the holding tray 55, the holding tray 55 is positioned at the set position 53 wherein the holding tray 55 is drawn out to the frontmost position as shown in FIGS. 5 and 9. The movement of the holding tray 55 between the recording execution ending position 61 and the set position 53 is carried out by causing the left and right guide arms 74L and 74R to be pinched by the transport roller 34 as shown in the drawings. In the course of the movement of the holding tray 55 between the storage position 54 and the recording execution start position 60, the movement of the holding tray 55 between the recording execution start position 60 and the recording execution ending position 61, and the movement of the holding tray 55 between the recording execution ending position 61 and the set position 53, the guide pins 79 and 79 provided at the proximal end portions 74*b* and 74*b* of the guide arms 74L and 74R are always in a state of being engaged with the guide rails 77L and 77R, and the postures of the guide arms 74L and 74R are continuously changed from the folded state shown in FIGS. 2 and 6 to the extended state shown in FIGS. 5 and 9.

The operation state of the holding tray 55 according to the present embodiment during movement from the set position 53 to the storage position 54 is opposite to the above-described operation state, and the details thereof are the same as those of the above.

Other Embodiment

Although the recording apparatus 1 according to the present embodiment basically has the above-described configuration, a partial configuration may be modified or omitted within the range without departing from the spirit of the invention. For example, the holding tray 55 may have not only a configuration that it is completely accommodated within the interior space 58 of the path forming member 57, but also a configuration that a part of the holding tray 55 comes out from the interior space 58 of the path forming member 57. Moreover, the configuration of the extending movement mechanism 59 is not limited to the configuration shown in the above-described embodiment but may have a configuration that uses a link mechanism or a cam mechanism. Furthermore, the configuration of the auxiliary transport mechanism 67 is not limited to the rack and pinion mechanism employed in the above-described embodiment, but may employ various mechanisms capable of securing the same movement amount.

What is claimed is:

1. A recording apparatus comprising:

a recording head;

a reverse transporting portion for transporting a first recording material which is reversed in a U shape;

a holding tray on which a second recording material is set and which is configured to be advanced and retracted in a linear path between a recording position wherein the holding tray opposes the recording head and an internal storage position wherein the holding tray is retracted from the recording position;

and a path forming member for guiding the reversed first recording material to the linear path after the first recording material is bypassed above the internal storage position.

2. The recording apparatus according to claim 1, wherein the path forming member is integrally formed with a support portion for supporting the holding tray at the internal storage position.

3. The recording apparatus according to claim 1, wherein a front end portion of the holding tray being retracted to the internal storage position protrudes to a position located between the linear path and a guide path formed by the path forming member.

4. The recording apparatus according to claim 3, further comprising a pivoting flap which is provided at a converging position of the linear path and the guide path formed by the path forming member.

* * * * *